US008186840B2

(12) United States Patent
Wu et al.

(10) Patent No.: US 8,186,840 B2
(45) Date of Patent: May 29, 2012

(54) STANDARD ILLUMINANT APPARATUS CAPABLE OF PROVIDING STANDARD LED LIGHT

(75) Inventors: Kuei-Neng Wu, Taipei (TW); Cheng-Hsien Chen, Chiayi (TW); Chia-Ying Chang, Taichung (TW); Ming-Chieh Huang, Taipei County (TW)

(73) Assignee: Industrial Technology Research Institut, Hsin-Chu (TW)

( * ) Notice: Subject to any disclaimer, the term of this patent is extended or adjusted under 35 U.S.C. 154(b) by 950 days.

(21) Appl. No.: 12/196,500

(22) Filed: Aug. 22, 2008

(65) Prior Publication Data

US 2009/0167189 A1 Jul. 2, 2009

(30) Foreign Application Priority Data

Dec. 31, 2007 (TW) ..... 96151383 A

(51) Int. Cl.
*G09F 13/04* (2006.01)

(52) U.S. Cl. ..... 362/97.1; 362/558; 362/97.4

(58) Field of Classification Search ..... 362/558, 362/97.1, 97.4
See application file for complete search history.

(56) References Cited

U.S. PATENT DOCUMENTS

| | | | | |
|---|---|---|---|---|
| 5,424,930 | A * | 6/1995 | Kitoh et al. | 362/362 |
| 5,684,354 | A * | 11/1997 | Gleckman | 313/110 |
| 6,490,104 | B1 * | 12/2002 | Gleckman et al. | 359/819 |
| 7,132,805 | B2 | 11/2006 | Young | |

FOREIGN PATENT DOCUMENTS

| | | |
|---|---|---|
| TW | 200532323 | 10/2005 |
| TW | I281971 | 6/2007 |
| TW | I287687 | 10/2007 |

OTHER PUBLICATIONS

Taiwan Intellectual Property Office, "Office Action", Jun. 17, 2011, Taiwan.

* cited by examiner

*Primary Examiner* — Ali Alavi
(74) *Attorney, Agent, or Firm* — WPAT., P.C.; Justin King

(57) ABSTRACT

A standard illuminant apparatus suitable for providing a standard optical property of LED for measurement is provided. The standard illuminant apparatus comprises an illuminant module and light shape control module, wherein the illuminant module is capable of providing light, and the light shape control module is capable of receiving the light and transforming the light shape of the light to a predetermined light shape as a LED light shape.

22 Claims, 8 Drawing Sheets

420

420

520

620c

620b

620a

710b

710a

STANDARD ILLUMINANT APPARATUS CAPABLE OF PROVIDING STANDARD LED LIGHT

BACKGROUND OF THE INVENTION

1. Field of the Invention:

The present invention generally relates to a standard illuminant apparatus and, more particularly, to a standard illuminant apparatus capable of providing standard optical property of LED for measurement.

2. Description of the Prior Art:

Since the light emitting diode (LED) is advantageous in long lifetime, low power consumption, shock resistance, mass production, light weight, compactness and fast response, it has been widely used in general lighting, backlight modules for liquid-crystal displays (LCD's) and automotive illumination. In general, quality parameters for the LED include luminous intensity, luminous flux, and chromaticity. However, the time-dependent optical property of LED and the special light-emitting distribution lead to poor precision in measurement. The optical property of LED depends strongly on the temperature. For example, heat is generated in LED chip as light is emitted from the LED. Such heat causes the luminous intensity to change. As a result, the luminous intensity of light from the LED measured in a period of time becomes unstable and unreliable. Moreover, the result is different even if the same LED is measured several days later. In other words, the reproducibility is poor.

Consequently, parameters of the luminous intensity are questionable especially when the same LED is measured by different testers. Generally, an LED with better quality is used as a standard for calibration. However, no matter how the LED is manufactured, it exhibits poor reliability and reproducibility.

Moreover, a conventional temperature-controlled LED is also used as standard light source. By detecting the temperature around the LED, a current is provided to the LED so as to improve the reliability of the LED. However, the temperature-controlled LED still suffers from poor reproducibility.

Furthermore, the LED can be implemented in many ways, for example, a surface-mounted LED light shape control module, a lamp-type LED light shape control module, an array-type LED light shape control module or an side-emitting LED light shape control module. The manufacturing cost of the standard illuminant apparatus is increased if the aforesaid LED's are modulated by a complicated temperature-controlled apparatus.

SUMMARY OF THE INVENTION

It is an object of the present invention to provide to a standard illuminant apparatus capable of providing LED light with high reliability and high reproducibility.

In order to achieve the foregoing object, the present invention provides a standard illuminant apparatus, comprising: an illuminant module and a light shape control module. The illuminant module is capable of providing light, and the light shape control module is capable of receiving light and transforming the light shape of light to a predetermined light shape as an LED light shape. Thereby, the standard illuminant apparatus is capable of providing standard LED light. In one embodiment of the present invention, the light shape control module comprises a diffuser plate and a first light shape control element. The first light shape control element is a first aperture disposed on the diffuser plate and having a first opening.

According to one embodiment of the present invention, the illuminant module is a halogen lamp. According to another embodiment of the present invention, the light shape control module comprises a second light shape control element disposed over the first light shape control element and being a predetermined pitch away from the first light shape control element. The light shape control module is a surface-mounted LED light shape control module, a lamp-type LED light shape control module, an array-type LED light shape control module or a side-emitting LED light shape control module, and the predetermined light shape is a surface-mounted LED light shape, a lamp-type LED light shape, an array-type LED light shape or a side-emitting LED light shape.

Therefore, in the standard illuminant apparatus of the present invention, the light from the illuminant module such as a halogen lamp exhibits high reliability and reproducibility, and the light shape control module is capable of transforming the light shape of the halogen lamp into an LED light shape. Therefore, according to the present invention, the standard illuminant apparatus is capable of providing light with an LED light shape with high reliability and reproducibility so as to be used as a standard for calibration.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PREFERRED EMBODIMENT

Figure 1B:
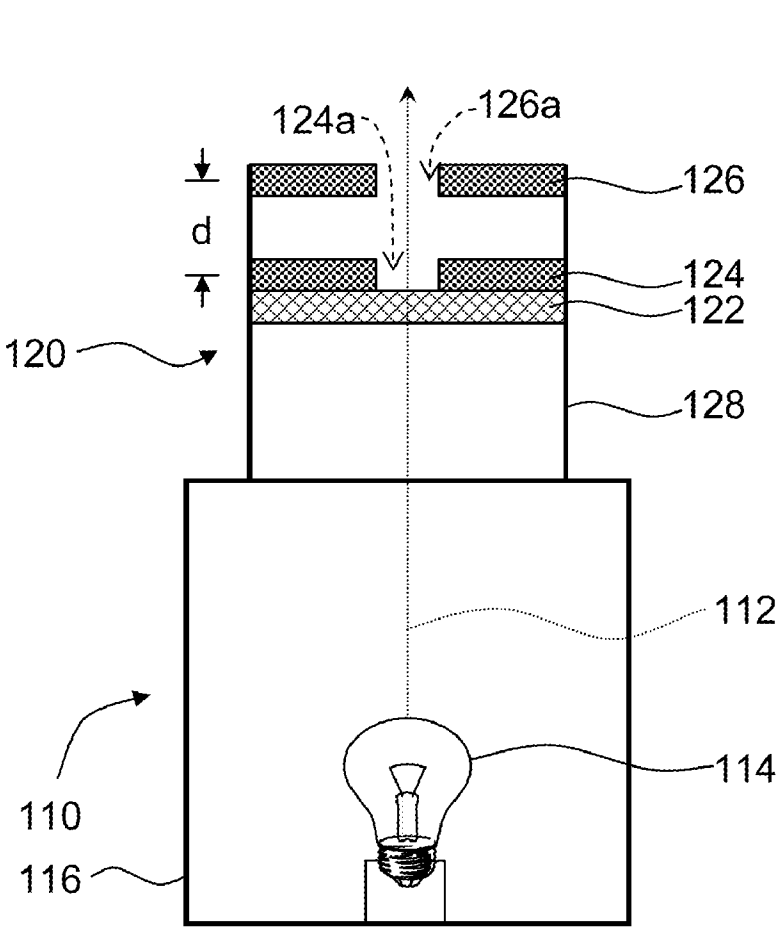
FIG. 1B is a cross-sectional view of a standard illuminant apparatus in FIG. 1A.

The present invention can be exemplified but not limited by the preferred embodiments as described hereinafter.

According to one embodiment of the present invention, a light shape control module is, for example, a lamp-type LED light shape control module, and the predetermined light shape is, for example, a lamp-type LED light shape. Moreover, the light shape control module comprises a diffuser plate, a first aperture and a second aperture. The first aperture is disposed on the diffuser plate, and comprises a first opening. The second aperture is disposed over the first aperture, and is a predetermined pitch away from the first aperture. The second aperture comprises a second opening aligned with the first opening. Alternatively, the light shape control module comprises a diffuser plate, a first aperture and a lens. The first aperture is disposed on the diffuser plate, and comprises a first opening. The lens is disposed over the first aperture, and is a predetermined pitch away from the first aperture.

According to one embodiment of the present invention, a light shape control module is, for example, an array-type LED light shape control module, and the predetermined light shape is, for example, an array-type LED light shape. Moreover, the light shape control module comprises a diffuser plate, a first aperture and a second aperture. The first aperture is disposed on the diffuser plate, and comprises a first opening. The second aperture is disposed over the first aperture, and is a predetermined pitch away from the first aperture. The second aperture comprises a plurality of second openings.

According to one embodiment of the present invention, a light shape control module is, for example, a surface-mounted LED light shape control module, and the predetermined light shape is a surface-mounted LED light shape. Moreover, the light shape control module comprises a diffuser plate and a first aperture. The first aperture is disposed on diffuser plate, and comprises a first opening.

According to one embodiment of the present invention, a light shape control module is, for example, a side-emitting LED light shape control module, and the predetermined light shape is, for example, aside-emitting LED light shape. Moreover, the light shape control module comprises a diffuser plate, a first aperture and a mask. The first aperture is disposed on the diffuser plate, and comprises a first opening. The mask is disposed over the first aperture, and is a predetermined pitch away from the first aperture. The mask is aligned with the first opening. Alternatively, the light shape control module comprises a diffuser plate, a first aperture, a lens and a mask. The first aperture is disposed on the diffuser plate, and comprises a first opening. The lens is disposed over the first aperture, and is a predetermined pitch away from the first aperture. The mask is disposed on the lens, and is aligned with the first opening. More particularly, the mask is disposed on one side of the lens, which is away from the first aperture. Alternatively, the light shape control module comprises a diffuser plate, a first aperture, a diffuser pole and a mask. The first aperture is disposed on the diffuser plate, and comprises a first opening. The diffuser pole penetrates the first opening and is coupled to the diffuser plate. The mask is disposed on the diffuser pole, and is aligned with the first opening. More particularly, the diffuser plate and the diffuser pole are formed as one.

According to one embodiment of the present invention, an illuminant module is, for example, a halogen lamp. Moreover, the illuminant module further comprises a lamp cover. The halogen lamp is disposed inside the lamp cover. Moreover, the illuminant module comprises an LED, a temperature control unit and a current control unit. The temperature control unit is capable of detecting the temperature of the LED, and the current control unit is capable of adjusting the current input into the LED according to the temperature of the LED. Moreover, the current control unit is, for example, capable of receiving the temperature of the LED from the temperature control unit. The LED is a lamp-type LED.

According to one embodiment of the present invention, the standard illuminant apparatus further comprises a light guide element. The light guide element is disposed between the illuminant module and the light shape control module to introduce the light from the illuminant module to the light shape control module. Moreover, the light guide element is, for example, a fiber or a tube.

Figure 1A:
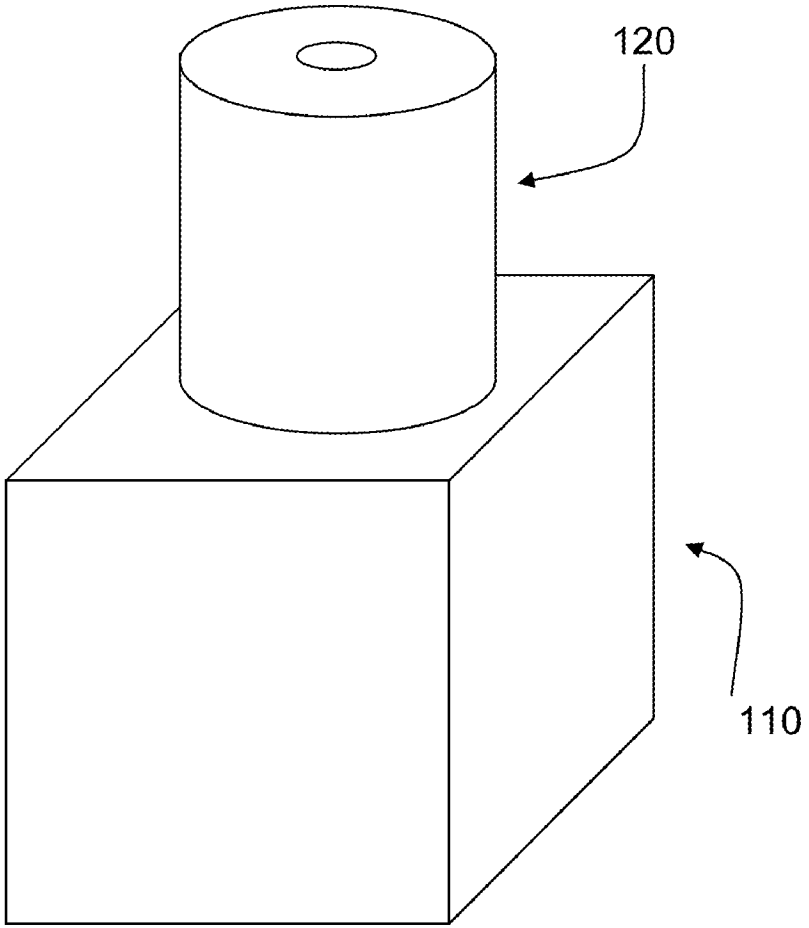
FIG. 1A is a 3-D schematic diagram showing a standard illuminant apparatus according to one embodiment of the present invention.

FIG. 1 is a 3-D schematic diagram of a standard illuminant apparatus according to one embodiment of the present invention; and FIG. 1B is a cross-sectional view of a standard illuminant apparatus in FIG. 1A. In FIG. 1A and FIG. 1B, the standard illuminant apparatus 100 comprises an illuminant module 110 and a light shape control module 120. The illuminant module 110 is capable of providing light 112, and the light shape control module 120 is capable of receiving light 112 and transforming the light shape of light 112 to a predetermined light shape as an LED light shape. More particularly, the predetermined light shape is an LED light shape. The light shape control module 120 is used to simulate the LED light shape to enable the standard illuminant apparatus 100 to simulate the light from the LED as a standard for calibration.

In the present embodiment, the illuminant module 110 comprises a halogen lamp 114 disposed inside a lamp box 116. Compared to the LED, the light 112 from the halogen lamp 114 exhibits better reliability and reproducibility. Therefore, the light 112 from the standard illuminant apparatus 100 exhibits high reliability and excellent reproducibility.

Moreover, the light shape control module 120 is, for example, a lamp-type LED light shape control module, and is capable of transforming the light 112 from the halogen lamp 114 to a lamp-type LED light shape. In other words, the light shape of the light 112 from the halogen lamp 114 is simulated to a lamp-type LED light shape.

Moreover, the light shape control module 120 comprises a diffuser plate 122, a first aperture 124 and a second aperture 126. The diffuser plate 122, the first aperture 124 and the second aperture 126 are disposed inside a cover 128. The diffuser plate 122 is capable of uniformizing the light 112. The first aperture 124 and the second aperture 126 are capable of adjusting the light shape of the light 112. More particularly, the first aperture 124 is disposed on the diffuser plate 122, and comprises a first opening 124*a*. The second aperture 126 is disposed on the first aperture 124, and is a predetermined pitch d away from the first aperture 124. The second aperture 126 comprises a second opening 126*a* aligned with the first opening 124*a*.

Alternatively, the light shape control module comprises a diffuser plate, a first aperture and a lens. The first aperture is disposed on the diffuser plate, and comprises a first opening. The lens is disposed over the first aperture, and is a predetermined pitch away from the first aperture.

In the present embodiment, the predetermined pitch d is 3.5 mm. The diameters of the first opening 124*a* and the second opening 126*a* are preferably 3 mm and 2 mm, respectively. By adjusting these parameters, the light shape of the light 112 can be transformed to a lamp-type LED light shape. As a result, the standard illuminant apparatus 100 is capable of simulating the lamp-type LED light with high reliability and reproducibility as a standard for calibration.

TABLE1

| | reproducibility | reliability |
|---|---|---|
| The present invention | 0.55% to 0.65% | 0.23% |
| The prior art (temperature-controlled LED) | 0.9% to 2.7% | 0.1% to 0.3% |
| The prior art (general LED) | 3% to 10% | 1.1% |

Figure 2:
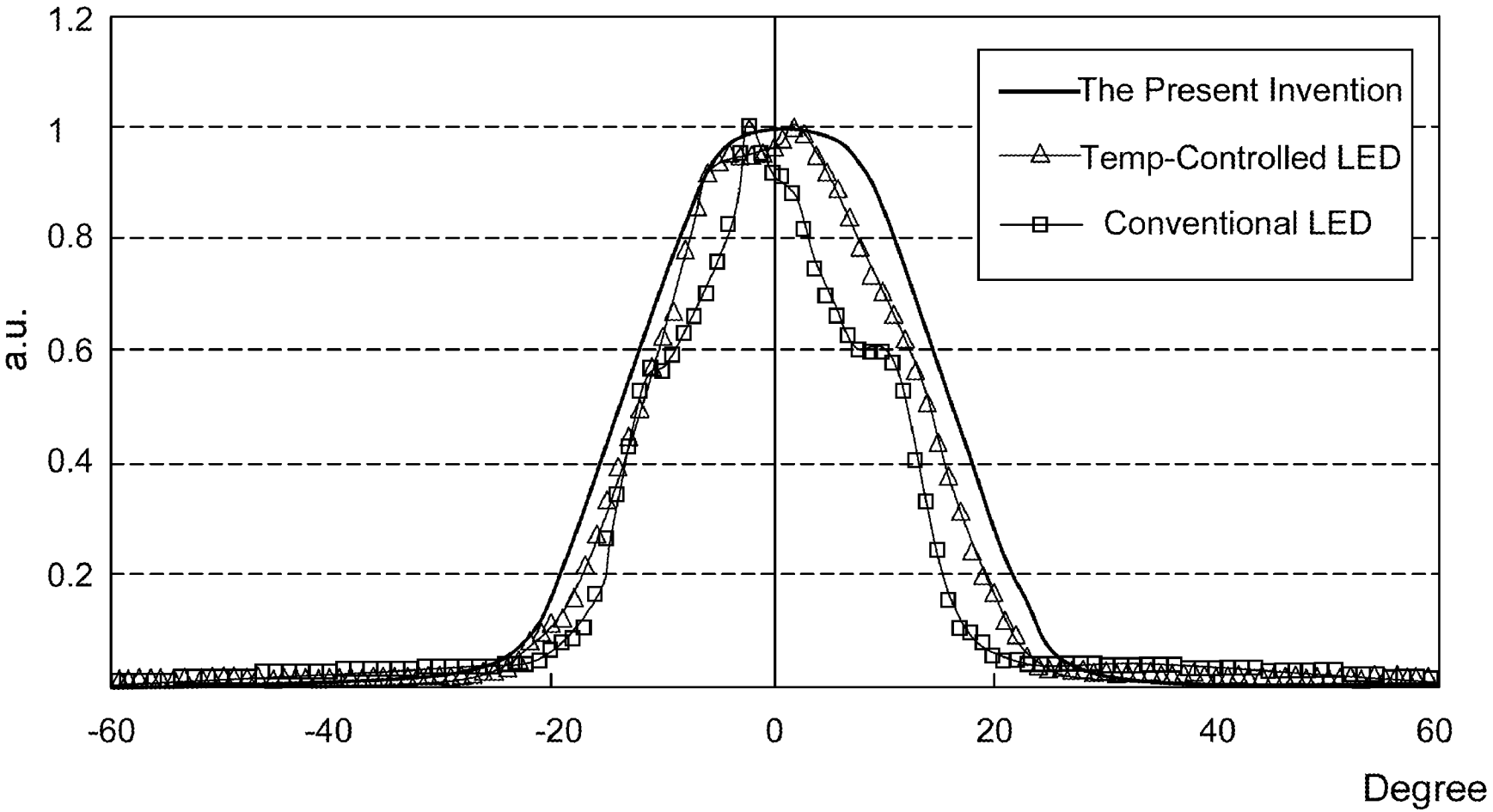
FIG. 2 shows the experimental results of light shapes of an embodiment of the present invention and conventional standard illuminant apparatuses.

Table 1 shows comparison of standard illuminant apparatuses according to the present invention and the prior arts. FIG. 2 shows the experimental results of light shapes of an embodiment of the present invention in FIG. 1A and conventional standard illuminant apparatuses. Referring to table 1 and FIG. 2, the standard illuminant apparatus of the present embodiment is capable of simulating the light shape of the light from the lamp-type LED, even better than the light shape of the light from the lamp-type LED. It is because the process for manufacturing the lamp-type light emitting diode is imperfect. With the influence of the temperature, the light shape of the light from the lamp-type LED is actually imperfect.

Moreover, when it comes to reliability, the reliability of the standard illuminant apparatus of the present embodiment is much higher than the general LED and almost equal to the temperature-controlled LED. When it comes to reproducibility, the reproducibility of the standard illuminant apparatus of the present embodiment is better than the general LED and the temperature-controlled LED. Therefore, the standard illuminant apparatus of the present invention is capable of providing light shape of light from an LED with high reliability and excellent reproducibility as a standard for calibration.

It is noted that the standard illuminant apparatus has to be calibrated before the standard illuminant apparatus is used as a standard for calibration. Generally, the technology of the according to the present invention can be traced back to absolute radiometric calibration of National Measurement Laboratory (NML) to properly adjust the luminous intensity and the light shape. Afterwards, it is used for calibrating the LED measuring apparatus such as an optical integrating sphere used in factories or laboratories.

It is also noted that the predetermined pitch d, the diameter of the first opening 124*a* and the diameter of the second opening 126*a* are only exemplary. Those with ordinary skills in the art can make modifications without departing from the spirits of the present invention. Moreover, the lamp-type LED light shape control module is not limited to the aforesaid embodiment. Other lamp-type LED light shape control modules will be described with identical labels used for identical elements.

Figure 3:
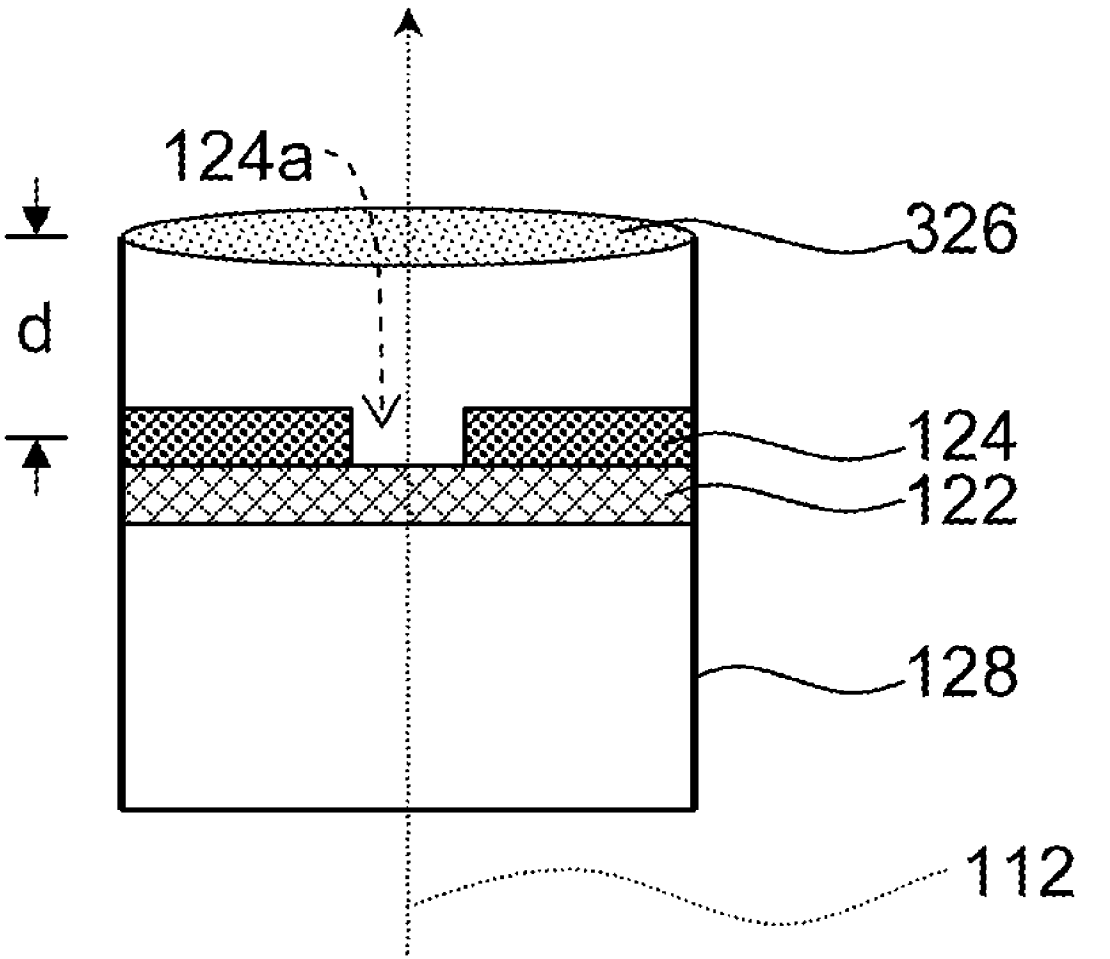
FIG. 3 is cross-sectional view of a light shape control module according to one embodiment of the present invention.

FIG. 3 is cross-sectional view of a light shape control module according to one embodiment of the present invention. In FIG. 3, the light shape control module 320 of the present embodiment, wherein the light shape control module 320 is a lamp-type LED light shape control module, is similar to the aforesaid light shape control module 120 (as shown in FIG. 1B) except that the light shape control module 320 uses a lens 326 to replace the second aperture 126. Similarly, by adjusting the predetermined pitch d, the diameter of the first opening 124*a* and the curvature of the lens 326, the light shape of the light 112 can be transformed to a lamp-type LED light shape.

It is also noted that the light shape control module is only exemplified by but not limited to the lamp-type LED light shape control module.

Figure 4B:
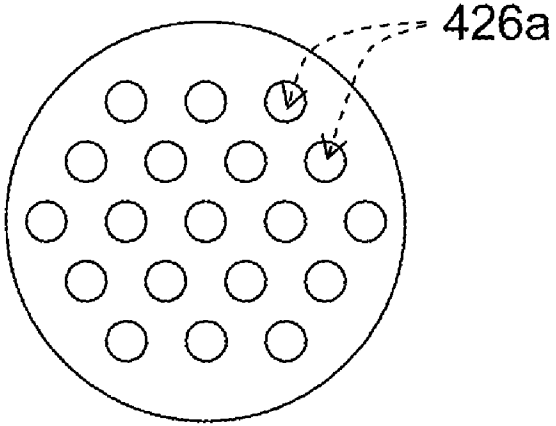
FIG. 4B is a top view of the light shape control module in FIG. 4A.
Figure 4A:
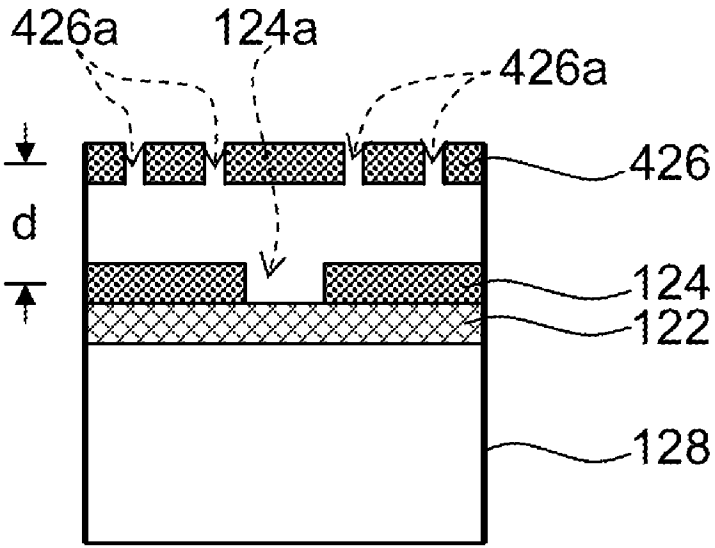
FIG. 4A is cross-sectional view of a light shape control module according to another embodiment of the present invention.

FIG. 4A is cross-sectional view of a light shape control module according to another embodiment of the present invention; and FIG. 4B is a top view of the light shape control module in FIG. 4A. Referring to FIG. 4A, 4B, the light shape control module 420 of the present embodiment is an array-type LED light shape control module. The light shape control module 420 of the present embodiment is different from the light shape control module 120 (as shown in FIG. 1B) in that the second aperture 426 comprises a plurality of second openings 426*a*. Similarly, by adjusting the predetermined pitch d, the diameter of the first opening 124*a* and the diameter of the second opening 426*a*, the light shape of the light 112 can be transformed to an array-type LED light shape.

Figure 5:
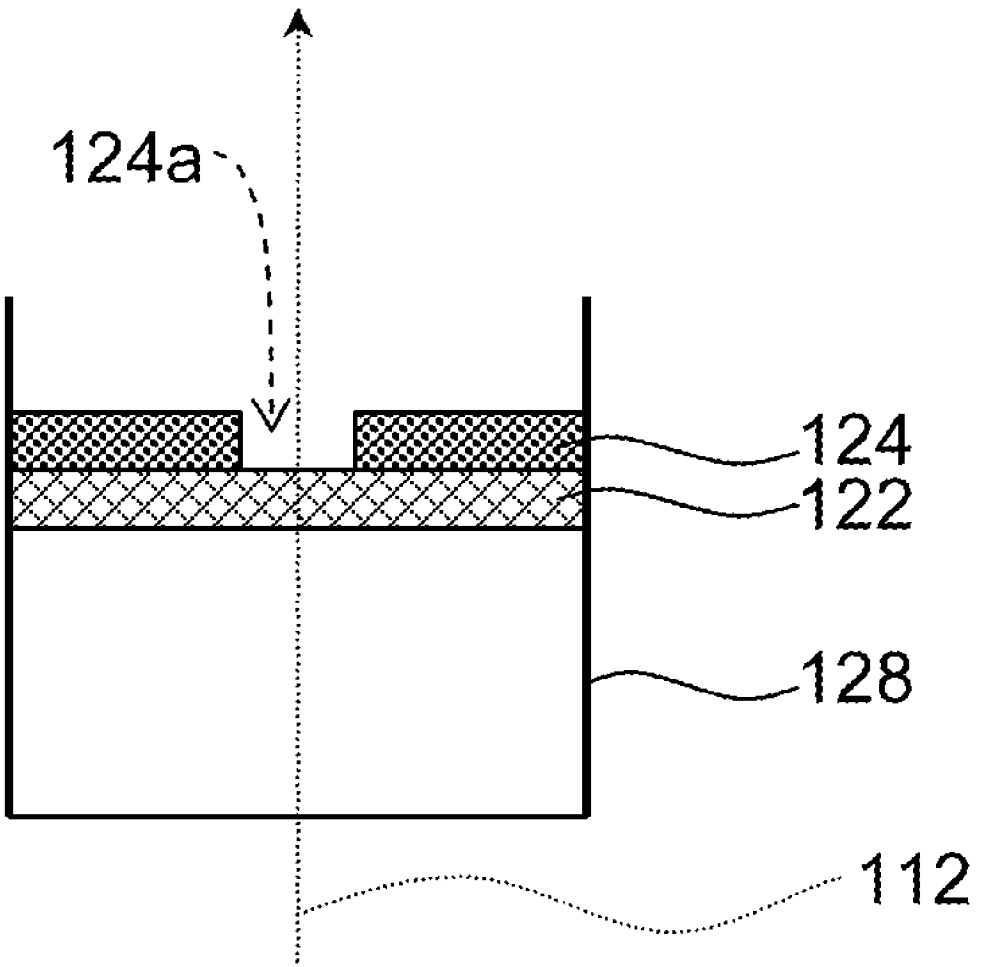
FIG. 5 is cross-sectional view of a light shape control module according to one embodiment of the present invention.

FIG. 5 is cross-sectional view of a light shape control module according to one embodiment of the present invention. Referring to FIG. 5, the light shape control module 520 of the present embodiment is a surface-mounted LED light shape control module. The light shape control module 520 of the present embodiment is different from the light shape control module 120 (as shown in FIG. 1B) in that the second aperture 126 is not disposed in the light shape control module 520. Similarly, by adjusting the diameter of the first opening 124*a*, the light shape of the light 112 can be transformed to a surface-mounted LED light shape.

Figure 6C:
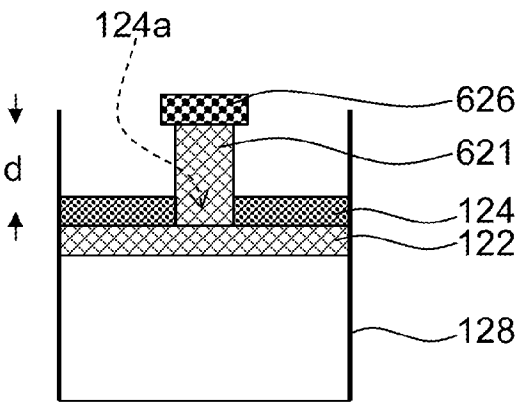
FIG. 6A to FIG. 6C show cross-sectional views of three light shape control modules according to another embodiment of the present invention.
Figure 6B:
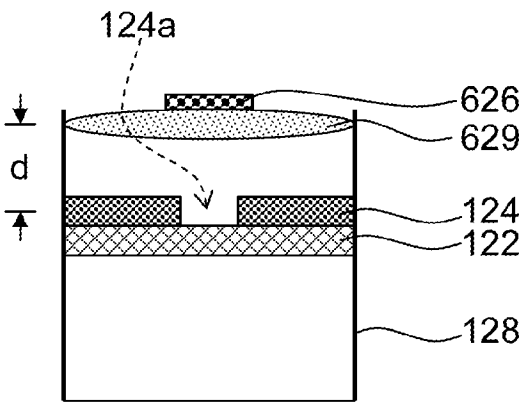
Figure 6A:
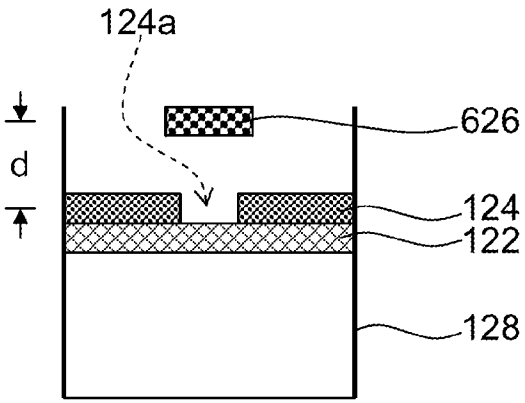

FIG. 6A to FIG. 6C show cross-sectional views of three light shape control modules according to another embodiment of the present invention. These three light shape control modules are all side-emitting LED control modules. Referring to FIG. 6A, the light shape control module 620*a* of the present embodiment is similar to the light shape control module 120 (as shown in FIG. 1B) except that the light shape control module 620*a* uses a mask 626 to replace the second aperture 126. The mask 626 is aligned with the first opening 124. Similarly, by adjusting the predetermined pitch d, the diameter of the first opening 124*a*, the area of the mask 626, and the light shape of the light 112 can be transformed to a side-emitting LED light shape.

Referring to FIG. 6B, the light shape control module 620*a* of the present embodiment is similar to the light shape control module 620*a* (as shown in FIG. 6A) except that the light shape control module 620*b* further comprises a lens 629. More particularly, the lens 629 is disposed over the first aperture, and is a predetermined pitch d away from the first aperture 124. Moreover, the mask 626 is disposed on the lens 629, and is aligned with the first opening 124. Similarly, by adjusting the predetermined pitch d, the diameter of the first opening 124*a*, the curvature of the lens 629 and the area of the mask 626, the light shape of the light 112 can be transformed to a side-emitting LED light shape.

It is also noted that the mask 626 is disposed on one side of the lens 629, which is away from the first aperture 124. However, in other embodiment, the mask 626 can be disposed on one side of the lens 629, which is close to the first aperture 124.

Referring to FIG. 6C, the light shape control module 620*c* of the present embodiment is similar to the light shape control module 620*a* (as shown in FIG. 6A) except that the light shape control module 620*c* further comprises a diffuser pole 621. More particularly, the diffuser pole 621 penetrates the first opening 124*a* and is coupled to the diffuser plate 122. The mask 626 is disposed on the diffuser pole 621, and is aligned with the first opening 124. Similarly, by adjusting the predetermined pitch d, the diameter of the first opening 124*a*, the curvature of the lens 629 and the area of the mask 626, the light shape of the light 112 can be transformed to a side-emitting LED light shape. Moreover, even though the diffuser pole 621 and the diffuser plate 122 are formed individually in the present embodiment. However, in other embodiments, the diffuser pole 621 and the diffuser plate 122 can be formed as one.

In the prior art, different LED's are used according to respective standard light. If these different LED's are implemented using temperature-controlled LED's, the cost for manufacturing the standard illuminant apparatus will be very high. In the present invention, different LED light shapes can be implemented by changing the internal elements in the light shape control module. Therefore, the manufacturing cost of the standard illuminant apparatus is significantly reduced.

Moreover, the high-reliability illuminant module used with the LED light shape control module can be used to simulate true LED light as standard light. Those with ordinary skills in the art cam make modifications on the illuminant module and/or the light shape control module within the scope of the present invention. For example, the illuminant module can be further modified as described hereinafter.

Figure 7B:
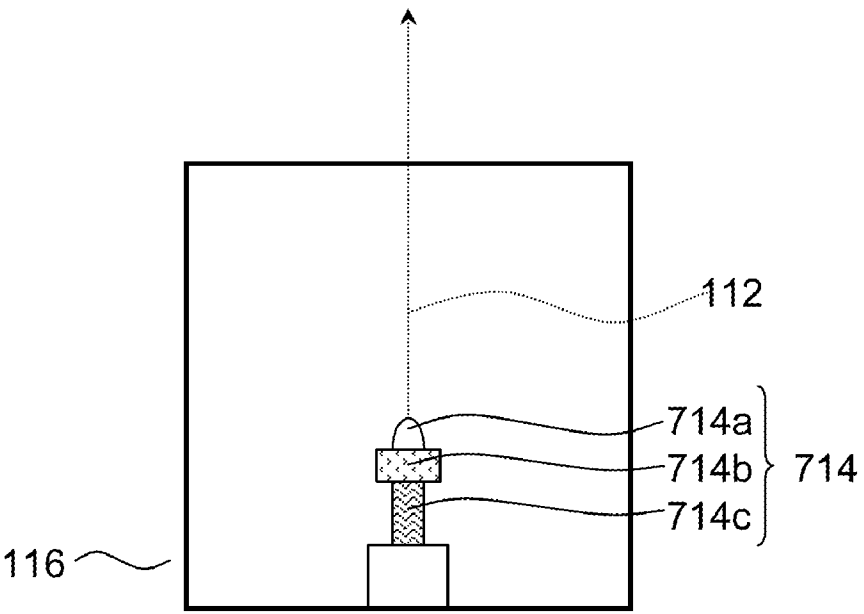
FIG. 7A and FIG. 7B show cross-sectional views of two illuminant modules according to another embodiment of the present invention.
Figure 7A:
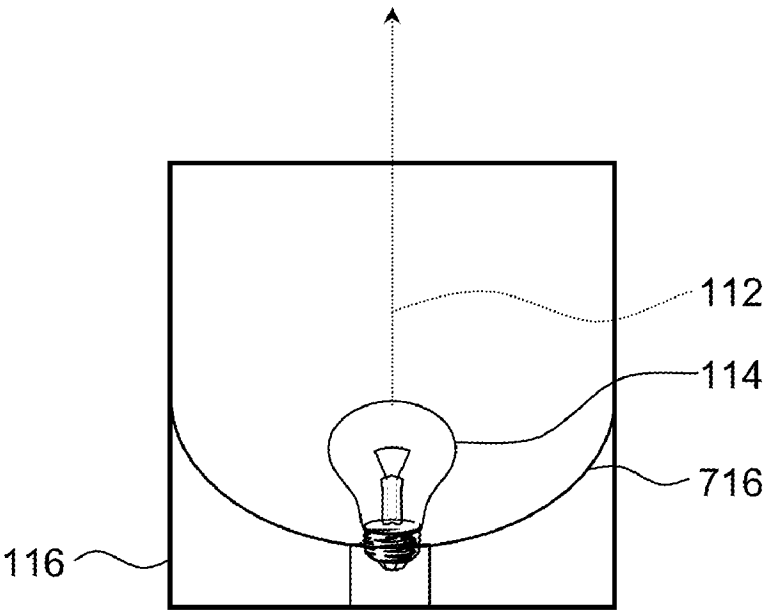

FIG. 7A and FIG. 7B show cross-sectional views of two illuminant modules according to another embodiment of the present invention. Referring to FIG. 7A, the illuminant module 710*a* of the present embodiment is similar to the illuminant module 110 (as shown in FIG. 1B) except that the illuminant module 710*a* further comprises a lamp cover 716. The halogen lamp 114 is disposed inside the lamp cover 716 so that the halogen lamp 114 is capable of providing uniform light 112.

Referring to FIG. 7B, the illuminant module 710*b* of the present embodiment is similar to the illuminant module 110 (as shown in FIG. 1B) except that the illuminant module 710*b* is a temperature-controlled LED 714 instead of the halogen lamp 114. More particularly, the temperature-controlled LED 714 comprises an LED 714*a*, a temperature control unit 714*b* and a current control unit 714*c*. The temperature control unit 714*b* is capable of detecting the temperature around the LED 714*a*, and the current control unit 714*c* receives the temperature of the LED 714*a* from the temperature control unit 714*b*. The current control unit 714*c* adjusts the current input into the LED 714*a* according to the temperature of the LED 714*a*.

In the present embodiment, the LED 714*a* is a lamp-type LED. It is noted that, even though the LED 714*a* is a lamp-type LED, the corresponding light shape control module is not restricted to a lamp-type LED light shape control module. In other words, the light shape control module can also be an array-type LED light shape control module or a surface-mounted LED light shape control module. The present invention is not limited to any type of light shape control modules.

Figure 8B:
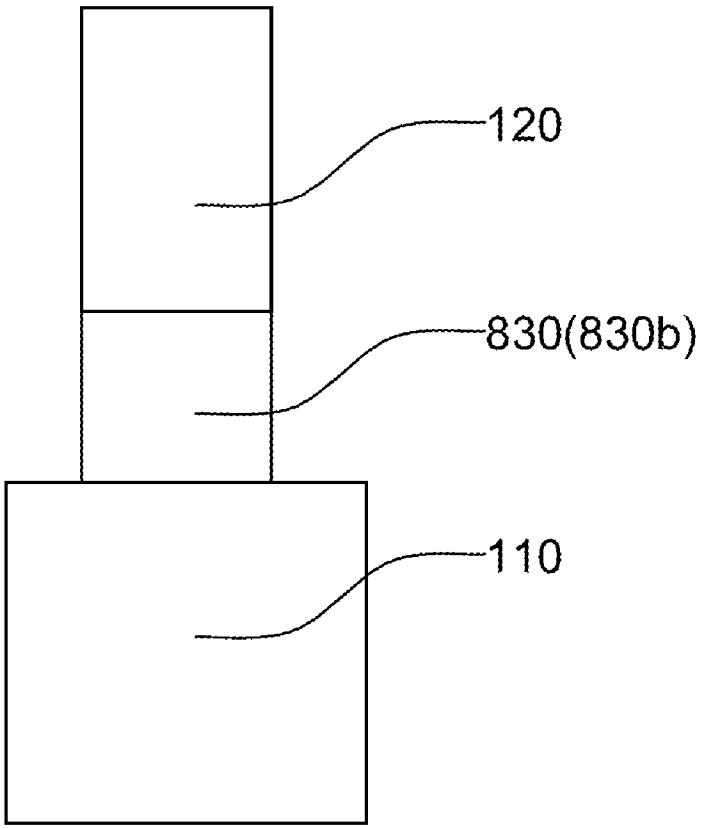
FIG. 8A and FIG. 8B show cross-sectional views of two standard illuminant apparatuses according to another embodiment of the present invention.
Figure 8A:
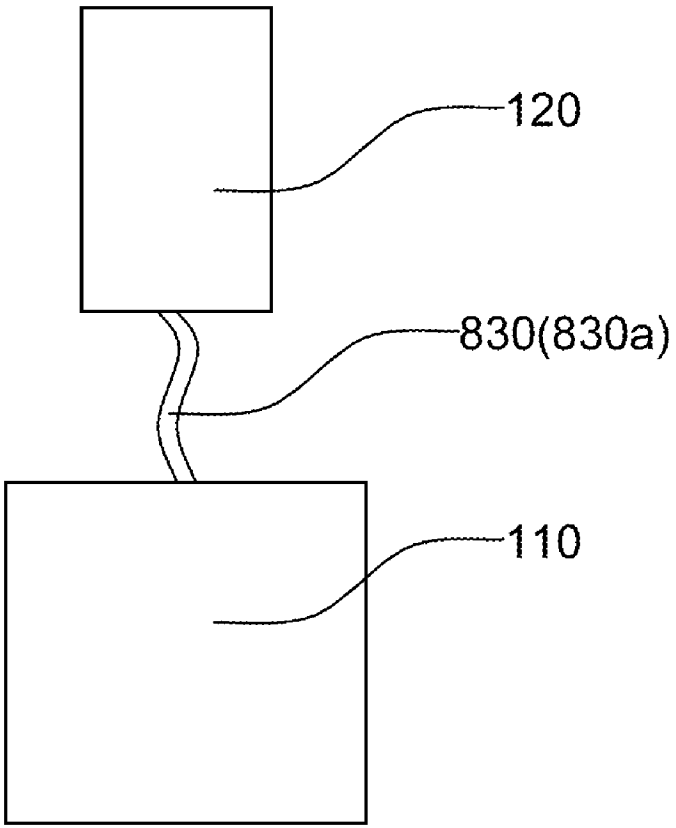

FIG. 8A and FIG. 8B show cross-sectional views of two standard illuminant apparatuses according to another embodiment of the present invention. Refer to FIGS. 8A and 8B, the standard illuminant apparatuses 800*a*, 800*b* of the present embodiment are similar to the standard illuminant apparatus 100 except that the standard illuminant apparatuses 800*a*, 800*b* further comprise a light guide element 830. The light guide element 830 is disposed between the illuminant module 110 and the light shape control module 120 to transmit light from the illuminant module 110 to the light shape control module 102. More particularly, the light guide element 830*a* in FIG. 8A is a fiber. The light guide element 830*b* in FIG. 8B is a tube. However, the present invention is not limited to any type of light guide elements.

Accordingly, the standard illuminant apparatus according to the present invention comprises at least advantages of:

1. Since the light from the illuminant module such as a halogen lamp exhibits high reliability and excellent reproducibility and the light shape control module is capable of transforming the light shape of light from the halogen lamp to an LED light shape, the standard illuminant apparatus is capable of providing light with an LED light shape exhibiting high reliability and excellent reproducibility as a standard for calibration.

2. Different LED light shapes can be implemented by changing the internal elements in the light shape control module. Therefore, the manufacturing cost of the standard illuminant apparatus is significantly reduced.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A standard illuminant apparatus, capable of providing standard light-emitting diode (LED) light, the standard illuminant apparatus comprising:

an illuminant module capable of providing light; and a light shape control module, capable of receiving light and transforming the light shape of light to a predetermined light shape as an LED light shape;

wherein the light shape control module comprises a diffuser plate, a first light shape control element being a first aperture disposed on the diffuser plate and having a first opening, and a second light shape control element disposed over the first light shape control element and being a predetermined pitch away from the first light shape control element.

2. The standard illuminant apparatus as recited in claim 1, wherein the light shape control module is a surface-mounted LED light shape control module, and the predetermined light shape is a surface-mounted LED light shape.

3. The standard illuminant apparatus as recited in claim 1, wherein the light shape control module is a surface-mounted LED light shape control module, a lamp-type LED light shape control module, an array-type LED light shape control module or a side-emitting LED light shape control module, and the predetermined light shape is a surface-mounted LED light shape, a lamp-type LED light shape, an array-type LED light shape or a side-emitting LED light shape.

4. The standard illuminant apparatus as recited in claim 1, wherein the second light shape control element is a second aperture having a second opening and the second opening is aligned with the first opening.

5. The standard illuminant apparatus as recited in claim 4, wherein the light shape control module is a lamp-type LED light shape control module, and the predetermined light shape is a lamp-type LED light shape.

6. The standard illuminant apparatus as recited in claim 1, wherein the second light shape control element is a lens.

7. The standard illuminant apparatus as recited in claim 6, wherein the light shape control module is a lamp-type LED light shape control module, and the predetermined light shape is a lamp-type LED light shape.

8. The standard illuminant apparatus as recited in claim 6, wherein the light shape control module comprises a mask being disposed on the lens and aligned with the first opening.

9. The standard illuminant apparatus as recited in claim 8, wherein the light shape control module is a side-emitting LED light shape control module, and the predetermined light shape is a side-emitting LED light shape.

10. The standard illuminant apparatus as recited in claim 9, wherein the mask is disposed on one side of the lens, which is away from the first aperture.

11. The standard illuminant apparatus as recited in claim 1, wherein the second light shape control element is a mask being aligned with the first opening.

12. The standard illuminant apparatus as recited in claim 11, wherein the light shape control module is a side-emitting LED light shape control module, and the predetermined light shape is a side-emitting LED light shape.

13. The standard illuminant apparatus as recited in claim 1, wherein the light shape control module comprises:

a diffuser pole penetrating the first opening and being coupled to the diffuser plate; and a mask disposed over the diffuser pole and aligned with the first opening.

14. The standard illuminant apparatus as recited in claim 13, wherein the diffuser plate and the diffuser pole are formed as one.

15. The standard illuminant apparatus as recited in claim 1, wherein the illuminant module comprises a halogen lamp.

16. The standard illuminant apparatus as recited in claim 15, wherein the illuminant module comprises a lamp cover with the halogen lamp formed therein.

17. The standard illuminant apparatus as recited in claim 1, wherein the light shape control module comprises:

a light emitting diode (LED);

a temperature control unit capable of detecting the temperature of the LED; and a current control unit capable of adjusting the current input into the LED according to the temperature of the LED.

18. The standard illuminant apparatus as recited in claim 17, wherein the current control unit receives the temperature of the LED from the temperature control unit.

19. The standard illuminant apparatus as recited in claim 17, wherein the LED is lamp-type LED.

20. The standard illuminant apparatus as recited in claim 1, wherein the second light shape control element is a second aperture having a plurality of second openings.

21. The standard illuminant apparatus as recited in claim 20, wherein the light shape control module is an array-type LED light shape control module, and the predetermined light shape is an array-type LED light shape.

22. A standard illuminant apparatus, capable of providing standard light-emitting diode (LED) light, the standard illuminant apparatus comprising:

an illuminant module capable of providing light;

a light shape control module, capable of receiving light and transforming the light shape of light to a predetermined light shape as an LED light shape; and a light guide element disposed between the illuminant module and the light shape control module, and introducing the light from the illuminant module to the light shape control module;

wherein the light guide element is a fiber or a tube.

* * * * *